US011478047B2

(12) United States Patent
Yang

(10) Patent No.: US 11,478,047 B2
(45) Date of Patent: Oct. 25, 2022

(54) SELF-LACING SYSTEM FOR A SHOE AND VACUUM PUMP THEREOF

(71) Applicant: Universal Trim Supply Co., Ltd., New Taipei (TW)

(72) Inventor: Shih-Sheng Yang, Taipei (TW)

(73) Assignee: Universal Trim Supply Co., Ltd., New Taipei (TW)

( * ) Notice: Subject to any disclaimer, the term of this patent is extended or adjusted under 35 U.S.C. 154(b) by 91 days.

(21) Appl. No.: 17/179,438

(22) Filed: Feb. 19, 2021

(65) Prior Publication Data

US 2021/0169177 A1 Jun. 10, 2021

Related U.S. Application Data

(63) Continuation-in-part of application No. 16/427,270, filed on May 30, 2019, now abandoned.

(51) Int. Cl.

| | |
|---|---|
| ***A43C 11/00*** | (2006.01) |
| ***A43B 13/14*** | (2006.01) |
| ***A43B 23/02*** | (2006.01) |

(52) U.S. Cl.

CPC ..... *A43C 11/00* (2013.01); *A43B 13/14* (2013.01); *A43B 23/029* (2013.01)

(58) Field of Classification Search

CPC ... A43B 23/028; A43B 23/029; A43B 13/203; A43C 11/00

USPC ..... 36/50.1

See application file for complete search history.

(56) References Cited

U.S. PATENT DOCUMENTS

| | | | | | |
|---|---|---|---|---|---|
| 5,383,290 | A * | 1/1995 | Grim | A43B 13/206 | 36/88 |
| 5,392,534 | A * | 2/1995 | Grim | A43B 7/147 | 36/154 |
| 5,477,626 | A * | 12/1995 | Kwon | A43B 7/082 | 36/3 R |
| 5,617,650 | A * | 4/1997 | Grim | A43B 7/147 | 36/154 |
| 5,813,142 | A * | 9/1998 | Demon | A43B 13/203 | 600/592 |
| 6,305,102 | B1 * | 10/2001 | Doyle | A43B 13/206 | 36/71 |
| 7,513,067 | B2 * | 4/2009 | Marvin | A43B 23/0255 | 36/88 |
| 7,900,378 | B1 * | 3/2011 | Busse | A43B 23/029 | 36/29 |
| 11,206,896 | B2 * | 12/2021 | Henrichot | A43B 3/38 | |

(Continued)

*Primary Examiner* — Marie D Bays

(74) *Attorney, Agent, or Firm* — Winston Hsu

(57) ABSTRACT

A self-lacing system includes an air bag assembly and a vacuum pump respectively attached on an upper portion and a sole portion of the shoe. The vacuum pump includes a first cover and a second cover. A chamber is formed between the first cover and the second cover when the second cover is located at the first position relative to the first cover. Volume of the chamber changes during movement of the second cover relative to the first cover. During the movement of the second cover relative to the first cover, the vacuum pump drives fluid inside the air bag assembly to flow into the chamber via a suction communication channel to collapse an air passage on the air bag assembly for shrinking and reshaping the air bag assembly, which drives the upper portion of the shoe to shrink and reshape for tightening the shoe.

17 Claims, 17 Drawing Sheets

(56) References Cited

U.S. PATENT DOCUMENTS

| | | | | |
|---|---|---|---|---|
| 2003/0046831 | A1* | 3/2003 | Westin | A43B 13/187 36/43 |
| 2004/0003517 | A1* | 1/2004 | Marvin | A43B 13/20 36/29 |
| 2004/0088882 | A1* | 5/2004 | Buttigieg | A43B 7/082 36/35 B |
| 2005/0229432 | A1* | 10/2005 | Lo | A43B 13/206 36/35 B |
| 2015/0265001 | A1* | 9/2015 | Kung | A43B 7/081 36/29 |
| 2017/0348181 | A1* | 12/2017 | Perriard | A43B 13/203 |
| 2018/0255865 | A1* | 9/2018 | Hsu | A43B 7/085 |
| 2019/0000186 | A1* | 1/2019 | Mou | A43B 23/029 |
| 2019/0053572 | A1* | 2/2019 | Patton | A43B 13/203 |
| 2019/0365042 | A1* | 12/2019 | Weast | A43B 13/188 |
| 2020/0375319 | A1* | 12/2020 | Yang | A43C 11/008 |
| 2021/0120915 | A1* | 4/2021 | Panian | A43B 23/029 |
| 2021/0169177 | A1* | 6/2021 | Yang | A43B 11/00 |
| 2021/0244128 | A1* | 8/2021 | Costa | A43B 3/0036 |
| 2022/0104582 | A1* | 4/2022 | Christensen | A43B 23/029 |

* cited by examiner

SELF-LACING SYSTEM FOR A SHOE AND VACUUM PUMP THEREOF

CROSS REFERENCE TO RELATED APPLICATIONS

This is a continuation in part application of U.S. patent application Ser. No. 16/427,270, filed on May 30, 2019, and the contents of this application are incorporated herein by reference.

BACKGROUND OF THE INVENTION

1. Field of the Invention

The present invention relates to a product fora shoe, and more particularly, to a self-lacing system for a shoe and a vacuum pump thereof.

2. DESCRIPTION OF THE PRIOR ART

With advancement of technology and development of economy, there are more and more consumer goods available in the market for satisfying different demands. For example, a shoelace is an important accessory for ensuring proper fit of the shoes. However, the shoelace gets loose easily during exercise, which may cause improper fit of the shoes and increase a risk of injury. In order to prevent injury, a wearer has to tie the shoelace again before the shoelace comes completely untied, which brings inconvenience in use.

SUMMARY OF THE INVENTION

Therefore, it is an objective of the present invention to provide a self-lacing system for a shoe and a vacuum pump for solving the aforementioned problem.

In order to achieve the aforementioned objective, the present invention discloses a self-lacing system for a shoe. The self-lacing system includes an air bag assembly and a vacuum pump. The air bag assembly is attached on an upper portion of the shoe. At least one air passage is formed on the air bag assembly. The vacuum pump is attached on a sole portion of the shoe. The vacuum pump includes a first cover and a second cover. A discharge port is formed on the first cover and has a discharge communication channel. The second cover is disposed on the first cover and movable relative to the first cover between a first position and a second position. A chamber is formed between the first cover and the second cover when the second cover is located at the first position relative to the first cover. Volume of the chamber changes during movement of the second cover relative to the first cover, and a suction port is formed on the second cover and has a suction communication channel. The chamber is compressed to force fluid, such as air, inside the chamber outwardly via the discharge communication channel when the second cover moves relative to the first cover from the first position to the second position, and when the second cover moves relative to the first cover from the second position to the first position, fluid, such as air, inside the air bag assembly is introduced to flow into the chamber via the suction communication channel to collapse the at least one air passage for shrinking and reshaping the air bag assembly, so that the upper portion of the shoe is driven by the air bag assembly to shrink and reshape for tightening the shoe.

According to an embodiment of the present invention, the vacuum pump further includes a discharge check valve configured to only allow the fluid inside the chamber to flow out of the chamber via the discharge communication channel in a single direction.

According to an embodiment of the present invention, the vacuum pump further includes a suction check valve configured to only allow the fluid inside the air bag assembly to flow into the chamber in a single direction.

According to an embodiment of the present invention, the vacuum pump further includes at least one resilient component disposed between the first cover and the second cover to bias the second cover to move relative to the first cover to the first position.

According to an embodiment of the present invention, the vacuum pump further includes at least one sealing component disposed between the first cover and the second cover.

According to an embodiment of the present invention, the first cover includes at least one first engaging portion. The second cover includes at least one second engaging portion, and the at least one first engaging portion engages with the at least one second engaging portion when the second cover moves relative to the first cover to the first position.

According to an embodiment of the present invention, the vacuum pump further includes a connecting head connected to the suction port and the air bag assembly, and the connecting head has a connection communication channel configured to communicate the air bag assembly to the suction communication channel.

According to an embodiment of the present invention, the connecting head is detachably connected to the suction port, and the vacuum pump further includes at least one sealing component disposed between the connecting head and the suction port.

According to an embodiment of the present invention, the first cover includes an inner wall and an outer wall located outside the inner wall. The second cover includes an inner protruding platform and an outer abutting platform wall located outside the inner protruding platform. The chamber is enclosed by the inner wall and the inner protruding platform. At least one accommodating space is formed between the inner wall and the outer wall, and the vacuum pump further includes at least one resilient component disposed inside the at least one accommodating space and abutting against the outer abutting platform.

According to an embodiment of the present invention, the first cover further includes at least one first engaging portion protruding from the inner wall. The second cover further includes at least one second engaging portion protruding from the outer abutting platform, and the at least one first engaging portion engages with the at least one second engaging portion when the second cover moves relative to the first cover to the first position.

In order to achieve the aforementioned objective, the present invention further discloses a vacuum pump for evacuating an air bag assembly. The vacuum pump includes a first cover and a second cover. A discharge port is formed on the first cover and has a discharge communication channel. The second cover is disposed on the first cover and movable relative to the first cover between a first position and a second position. A chamber is formed between the first cover and the second cover when the second cover is located at the first position relative to the first cover. Volume of the chamber changes during movement of the second cover relative to the first cover, and a suction port is formed on the second cover and has a suction communication channel. The chamber is compressed to force fluid, such as air, inside the chamber outwardly via the discharge communication channel when the second cover moves relative to the first cover from the first position to the second position, and fluid, such as air, inside the airbag assembly is introduced to flow into the chamber via the suction communication channel when the second cover moves relative to the first cover from the second position to the first position.

In summary, the present invention utilizes the vacuum pump disposed on the sole portion of the shoe to evacuate the air bag assembly disposed on the upper portion of the shoe. Therefore, the present invention allows a wearer to ensure proper fit of the shoe by stepping on the vacuum pump with a foot to evacuate the air bag assembly to reshape the upper portion of the shoe to the wearer. No other operation is needed, which brings convenience in use.

These and other objectives of the present invention will no doubt become obvious to those of ordinary skill in the art after reading the following detailed description of the preferred embodiment that is illustrated in the various figures and drawings.

DETAILED DESCRIPTION

In the following detailed description of the preferred embodiments, reference is made to the accompanying drawings which form a part hereof, and in which is shown by way of illustration specific embodiments in which the invention may be practiced. In this regard, directional terminology, such as "top," "bottom," "front," "back," etc., is used with reference to the orientation of the Figure (s) being described. The components of the present invention can be positioned in a number of different orientations. As such, the directional terminology is used for purposes of illustration and is in no way limiting. Accordingly, the drawings and descriptions will be regarded as illustrative in nature and not as restrictive.

Figure 1:
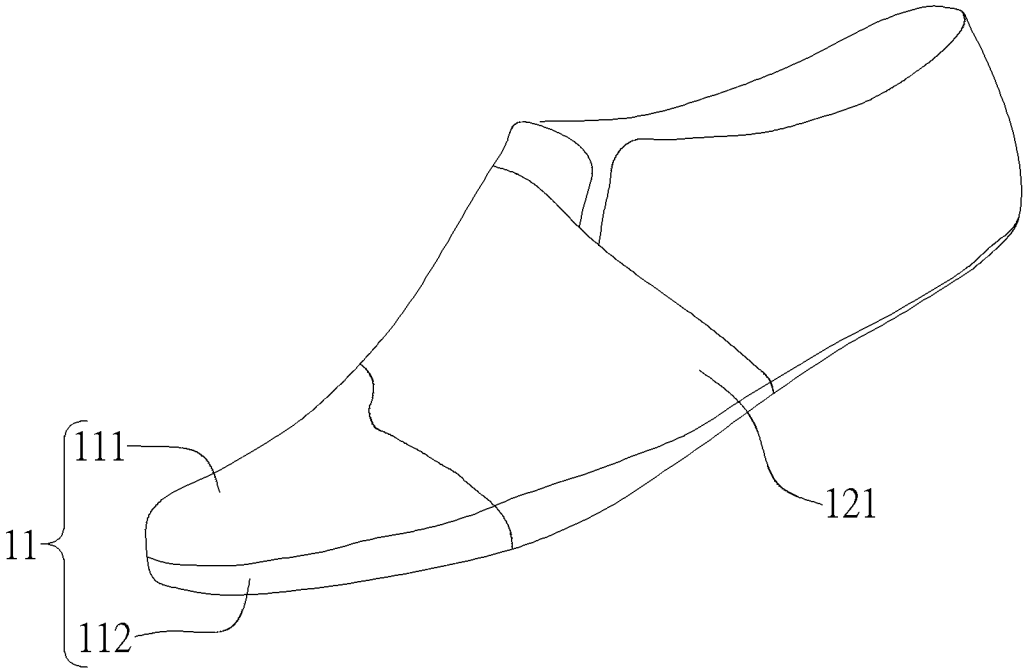
FIG. 1 is a schematic diagram of a self-lacing shoe according to a first embodiment of the present invention.
Figure 2:
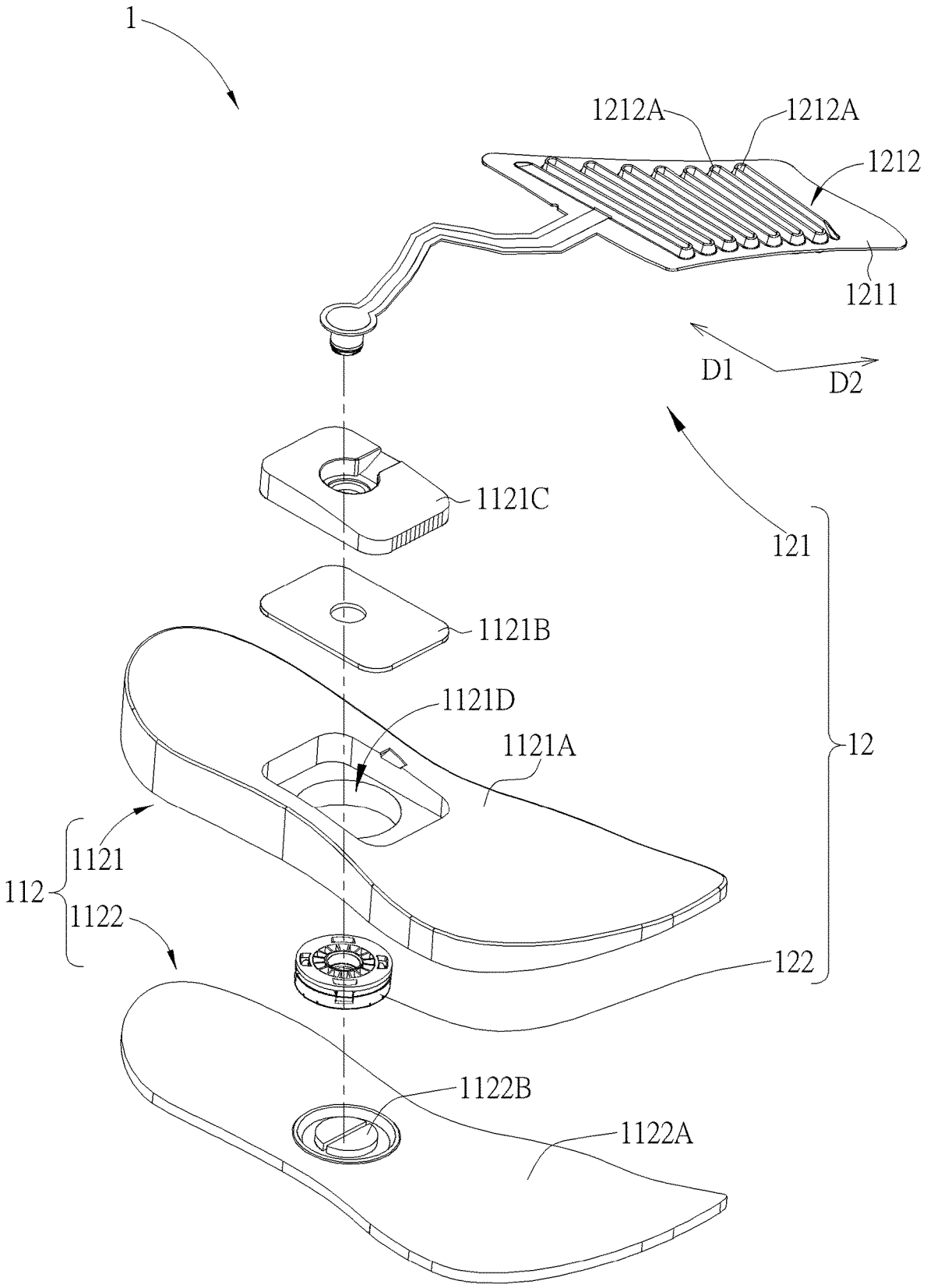
FIG. 2 is a partial exploded diagram of the self-lacing shoe according to the first embodiment of the present invention.
Figure 3:
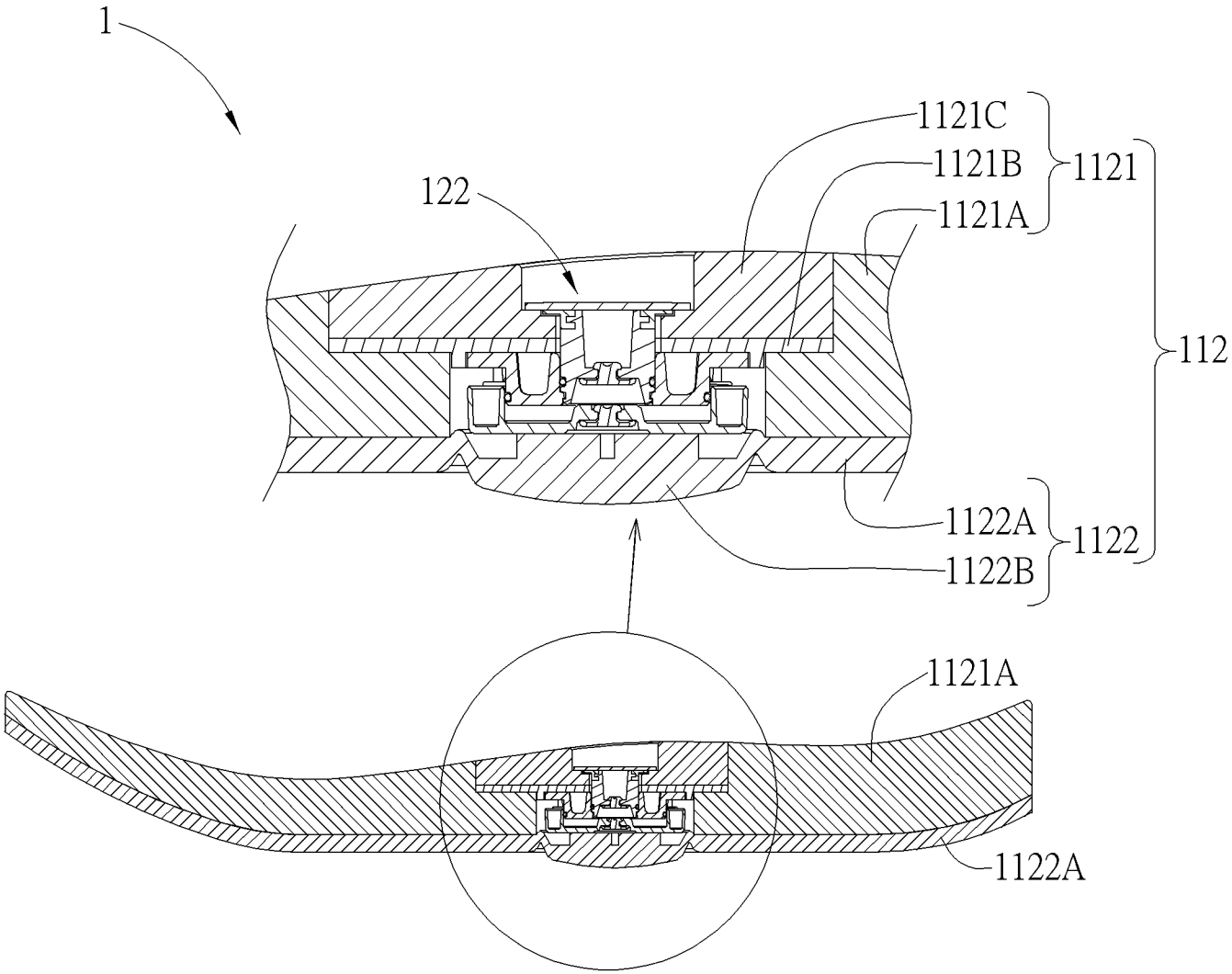
FIG. 3 is a partial sectional diagram of the self-lacing shoe according to the first embodiment of the present invention.

Please refer to FIG. 1 to FIG. 3. FIG. 1 is a schematic diagram of a self-lacing shoe 1 according to a first embodiment of the present invention. FIG. 2 is a partial exploded diagram of the self-lacing shoe 1 according to the first embodiment of the present invention. FIG. 3 is a partial sectional diagram of the self-lacing shoe 1 according to the first embodiment of the present invention. As shown in FIG. 1 to FIG. 3, the self-lacing shoe 1 includes a shoe 11 and a self-lacing system 12. The shoe 11 includes an upper portion 111 and a sole portion 112. The upper portion 111 can refer to a portion covering toes of a wearer, a top side and lateral sides of a foot of the wearer, and a rear side of a heel of the wearer. The sole portion 112 is combined with the upper portion 111 and can refer to a portion contacting with the ground for supporting the wearer. The sole portion 112 can be made from a variety of different materials, such as rubber, leather, polyurethane and EVA. The self-lacing system 12 includes an air bag assembly 121 and a vacuum pump 122 for evacuating the air bag assembly 121. The air bag assembly 121 can be attached on the upper portion 111 of the shoe 11. The vacuum pump 122 can be attached on the sole portion 112. In such a way, the vacuum pump 122 can be operated to evacuate the air bag assembly 121 to reshape the upper portion 111 of the shoe 11 for ensuring proper fit of the upper portion 111 of the shoe 11 when the wearer steps on the vacuum pump 122 with the foot.

In this embodiment, the sole portion 112 can include a midsole 1121 and an outsole 1122. The midsole 1121 can include a midsole body 1121A, a first pressure distribution component 1121B and a second pressure distribution component 1121C. A receiving recess 1121D can be formed on an arch part of the midsole body 1121A. The vacuum pump 122 can be received inside the receiving recess 1121D. The first pressure distribution component 1121B can at least cover a portion the vacuum pump 122 in a direct contacting manner. The first pressure distribution component 1121B can preferably be made of rigid material for uniformly distributing pressure acting on the vacuum pump 122. The second pressure distribution component 1121C can cover the first pressure distribution component 1121B and be aligned with an upper surface of the midsole body 1121A for contacting the wearer's foot. The second pressure distribution component 1121C can preferably be made of resilient material for providing wearing comfort. The outsole 1122 can include an outsole body 1122A and an abutting protrusion 1122B protruding from a bottom surface of the outsole body 1122A. The abutting protrusion 1122B can be forced by the ground to abut against the vacuum pump 122 for pressing the vacuum pump 122 to evacuate the air bag assembly 121.

Figure 4:
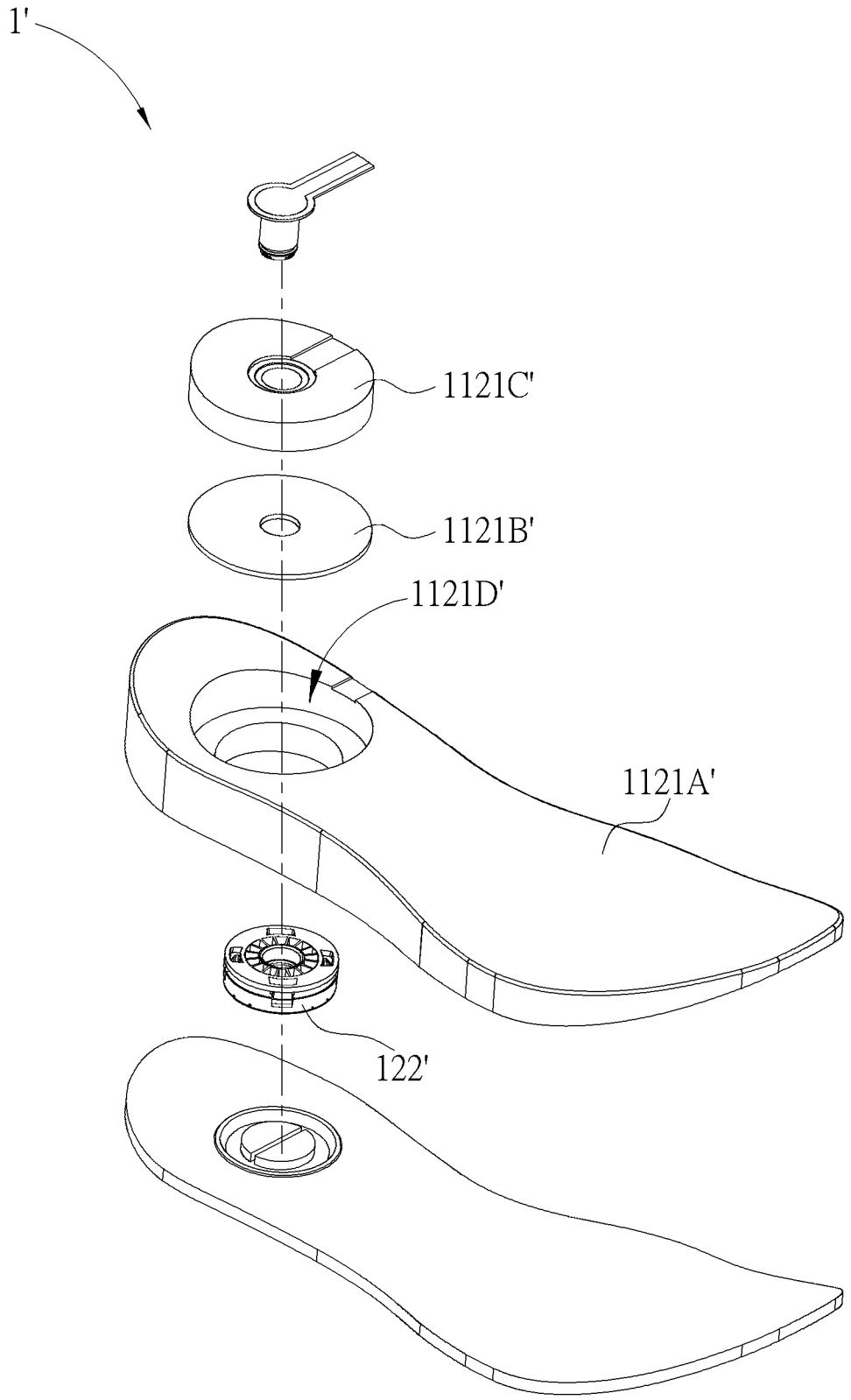
FIG. 4 is a partial exploded diagram of a self-lacing shoe according to a second embodiment of the present invention.
Figure 5:
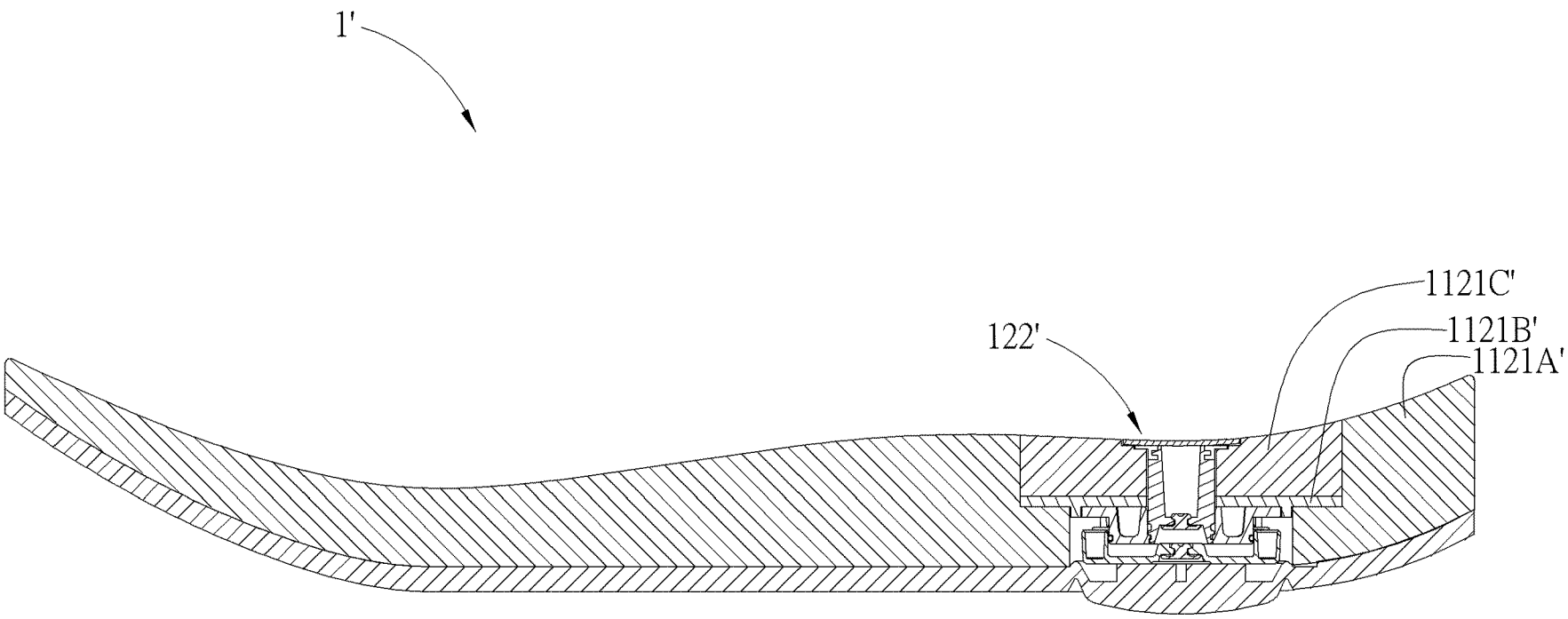
FIG. 5 is a partial sectional diagram of the self-lacing shoe according to the second embodiment of the present invention.

However, the present invention is not limited to this embodiment. Any configuration, which allows the wearer to operate the vacuum pump with the foot, is included within the scope of the present invention. For example, please refer to FIG. 4 and FIG. 5. FIG. 4 is a partial exploded diagram of a self-lacing shoe 1' according to a second embodiment of the present invention. FIG. 5 is a partial sectional diagram of the self-lacing shoe 1' according to the second embodiment of the present invention. As shown in FIG. 4 and FIG. 5, a receiving recess 1121D' of this embodiment can be formed on a heel part of a midsole body 1121A', i.e., a vacuum pump 122' can be disposed near the heel part of the midsole body 1121A'. Furthermore, the receiving recess 1121D', a first pressure distribution component 1121B' and a second pressure distribution component 1121C' can be formed in circular shapes which are different from the receiving recess 1121D, the first pressure distribution component 1121B and the second pressure distribution component 1121C of the first embodiment. Alternatively, in another embodiment, the first pressure distribution component can protrude from the upper surface of the midsole body, and the abutting protrusion can be omitted. Alternatively, in another embodiment, the first pressure distribution component and the second pressure distribution component can be omitted.

Furthermore, as shown in FIG. 2 of the first embodiment, the air bag assembly 121 can include one bag body 1211 disposed on the upper portion 111 of the shoe 11 and an air passage 1212 formed on the bag body 1121. The air passage 1212 is communicated with the vacuum pump 122 and includes a plurality of segments 1212A connected to each other. The plurality of segments 1212A extend along a first direction D1 and are arranged along a second direction D2 perpendicular to the first direction D1 in parallel. When the air bag assembly 121 is evacuated by the vacuum pump 122, the air passage 1212 is collapsed, so as to shrink and reshape the air bag assembly 121.

Figure 6:
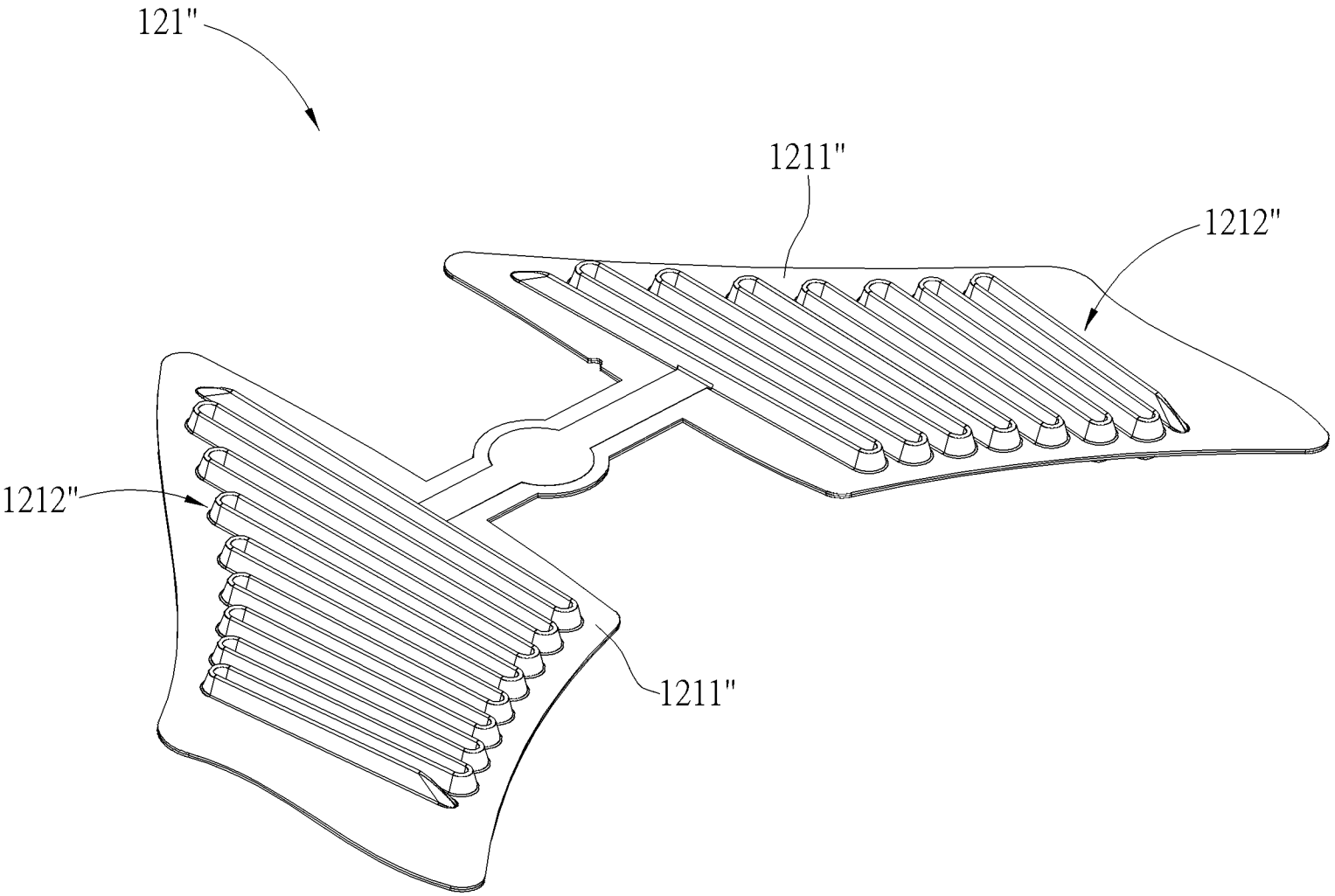
FIG. 6 is a partial exploded diagram of a self-lacing shoe according to a third embodiment of the present invention.
Figure 13:
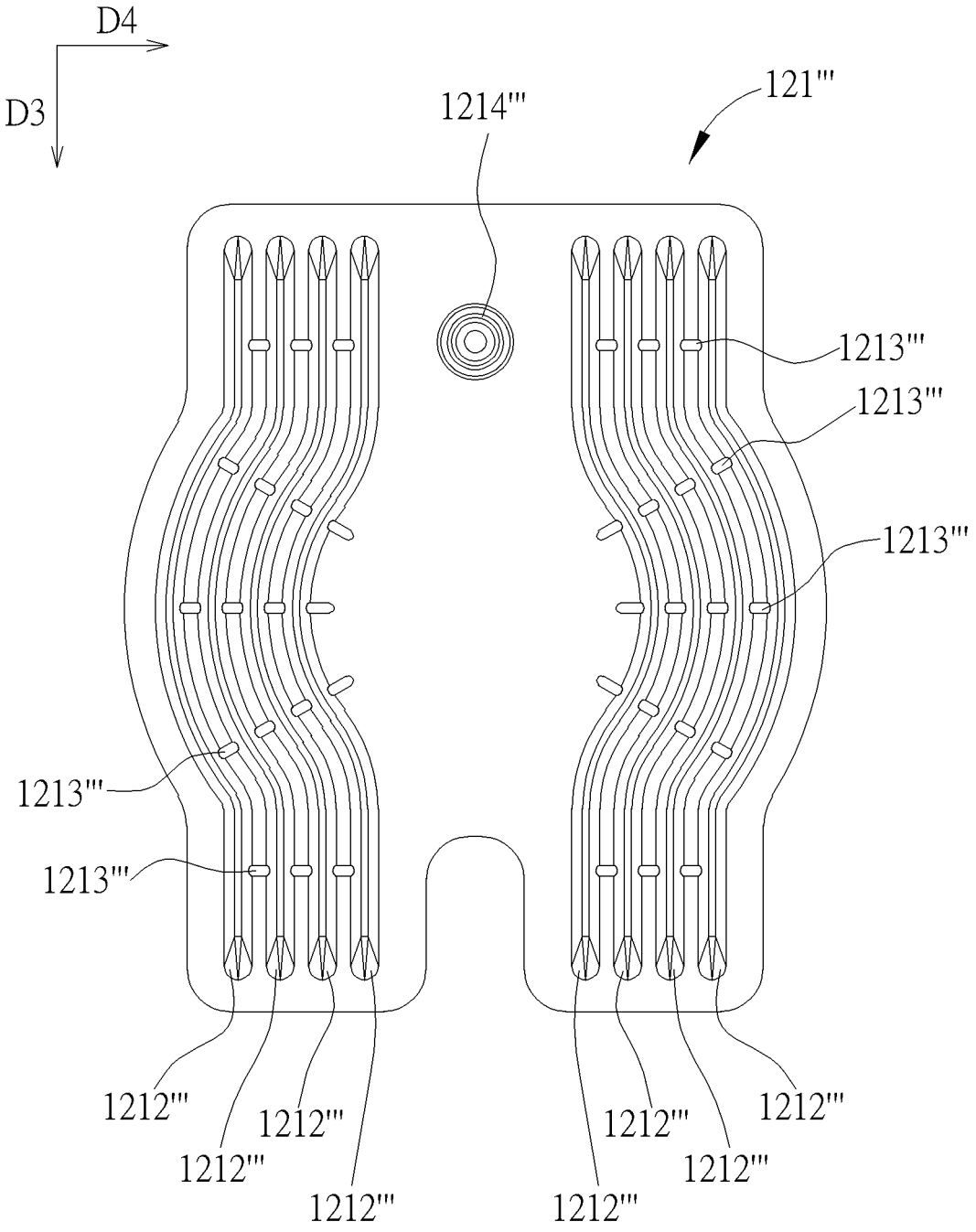
FIG. 13 is a diagram of an air bag assembly according to a fourth embodiment of the present invention.

However, structure of the air bag assembly of the present invention is not limited to the one illustrated in the figures. For example, please refer to FIG. 6. FIG. 6 is a diagram of an air bag assembly 121" according to a third embodiment of the present invention. As shown in FIG. 6, the air bag assembly 121" of this embodiment includes two symmetrical or asymmetrical bag bodies 1211" positioned on the upper portion of the shoe and two symmetrical or asymmetrical air passages 1212" communicated with each other. Furthermore, the number and the arrangement of the air bag assembly of the present invention are not limited to the ones illustrated in the figures of the present invention. For example, please refer to FIG. 13. FIG. 13 is a diagram of an air bag assembly 121' according to a fourth embodiment of the present invention. As shown in FIG. 13, in this embodiment, the vacuum pump also can be used to evacuate the air bag assembly 121' which is identical to ones of the air bag of U.S. patent application Ser. No. 16/274,206, and has a plurality of air channels 1213' communicated with the vacuum pump, which is not shown in the figures, and a plurality of air passages 1212' extending along a longitudinal direction D3 and communicated with each other via the plurality of air channels 1213'. The air bag assembly 121' can be contracted along a reshaping direction D4 perpendicular to the longitudinal direction D3 and/or the longitudinal direction D3 the when being exhausted by the vacuum pump and be expanded along the reshaping direction D4 and/or the longitudinal direction D3 when being inflated, e.g., by operation of a relief valve 1214'.

Figure 7:
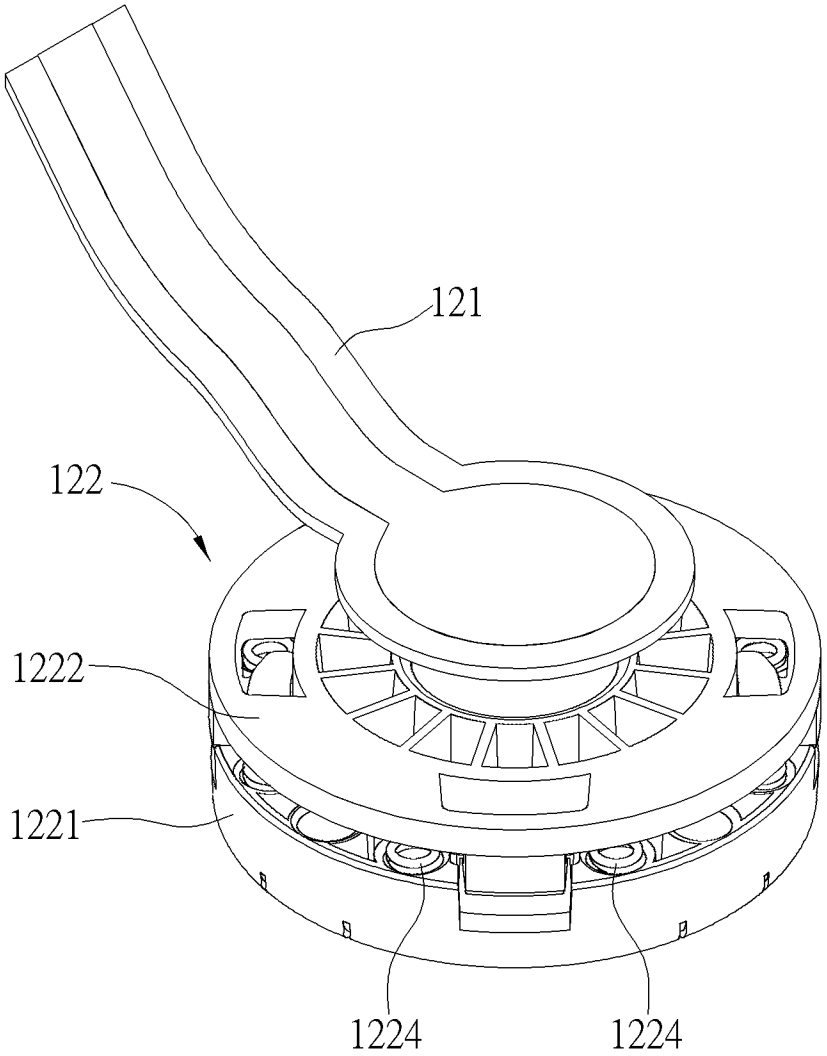
FIG. 7 is a partial diagram of the self-lacing system according to the first embodiment of the present invention.
Figure 8:
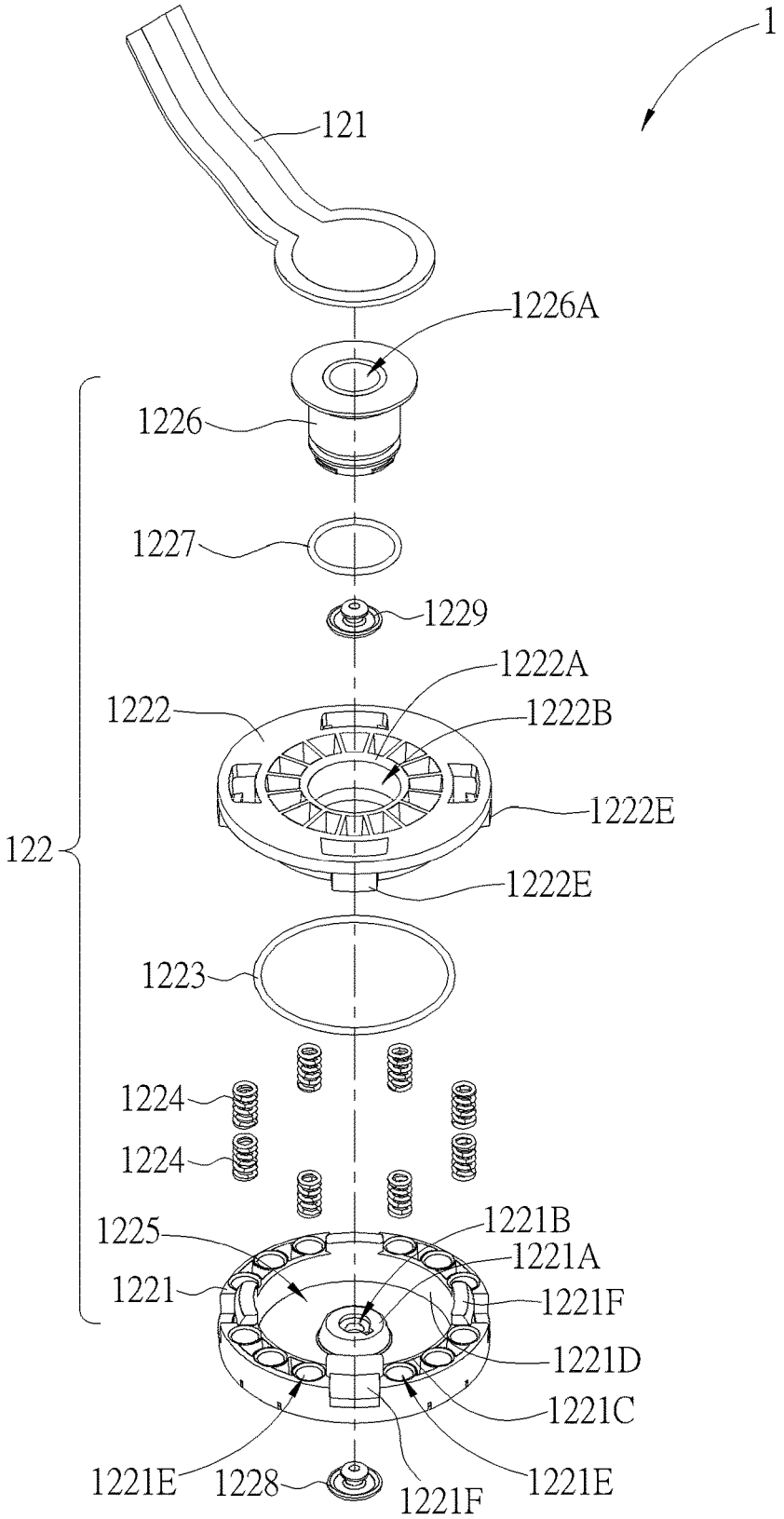
FIG. 8 is a partial exploded diagram of the self-lacing system according to the first embodiment of the present invention.
Figure 9:
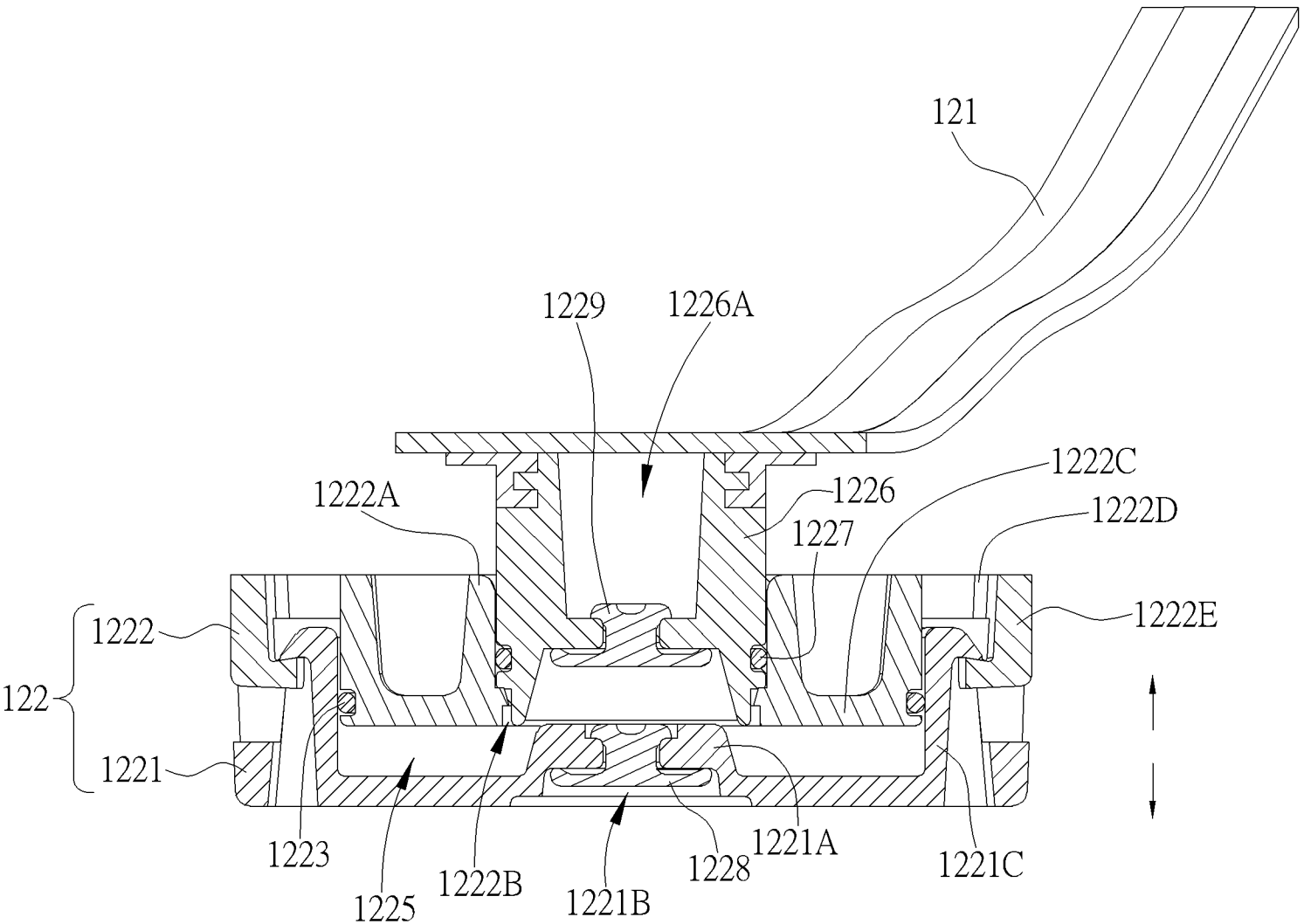
FIG. 9 is a partial sectional diagram of the self-lacing system according to the first embodiment of the present invention.
Figure 10:
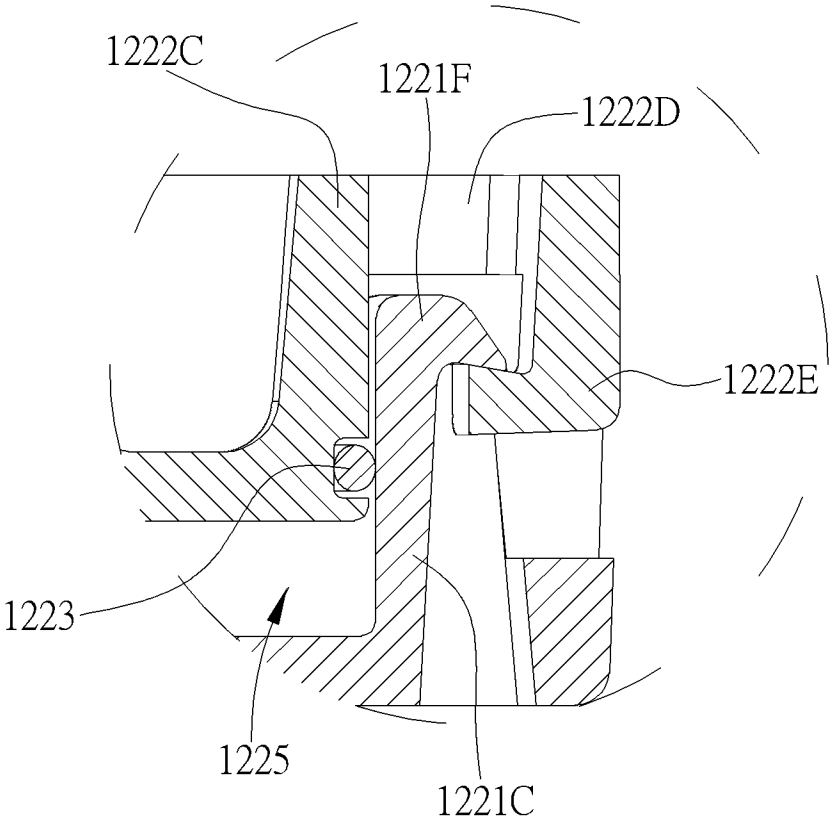
FIG. 10 is a partial enlarged diagram of the self-lacing system according to the first embodiment of the present invention.
Figure 11:
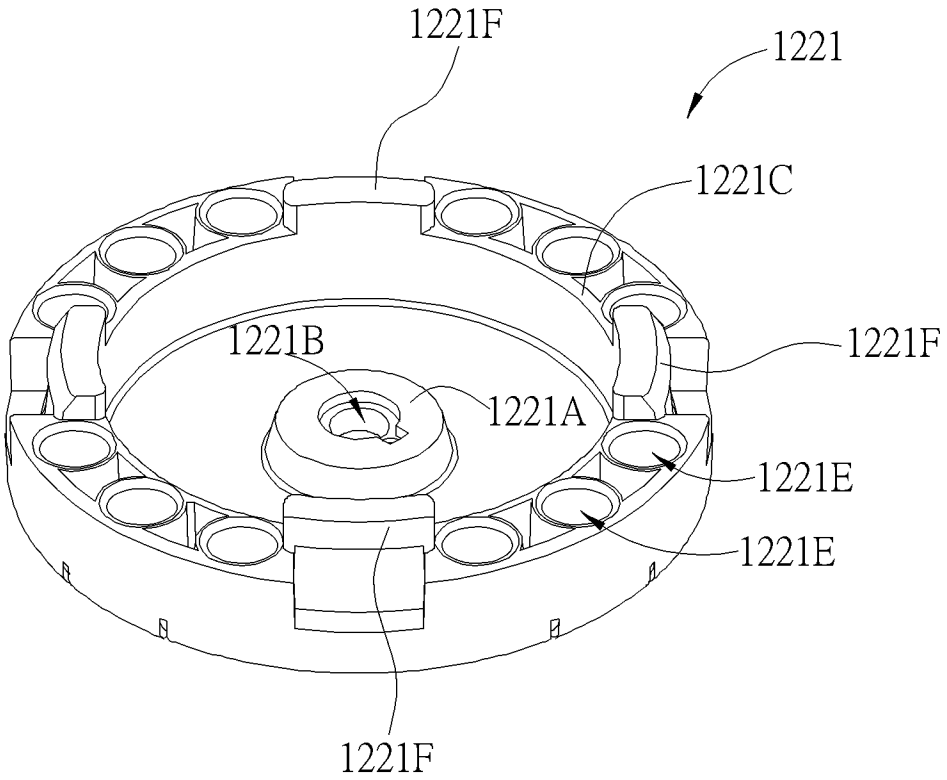
FIG. 11 is a diagram of a first cover of a vacuum pump according to the first embodiment of the present invention.
Figure 12:
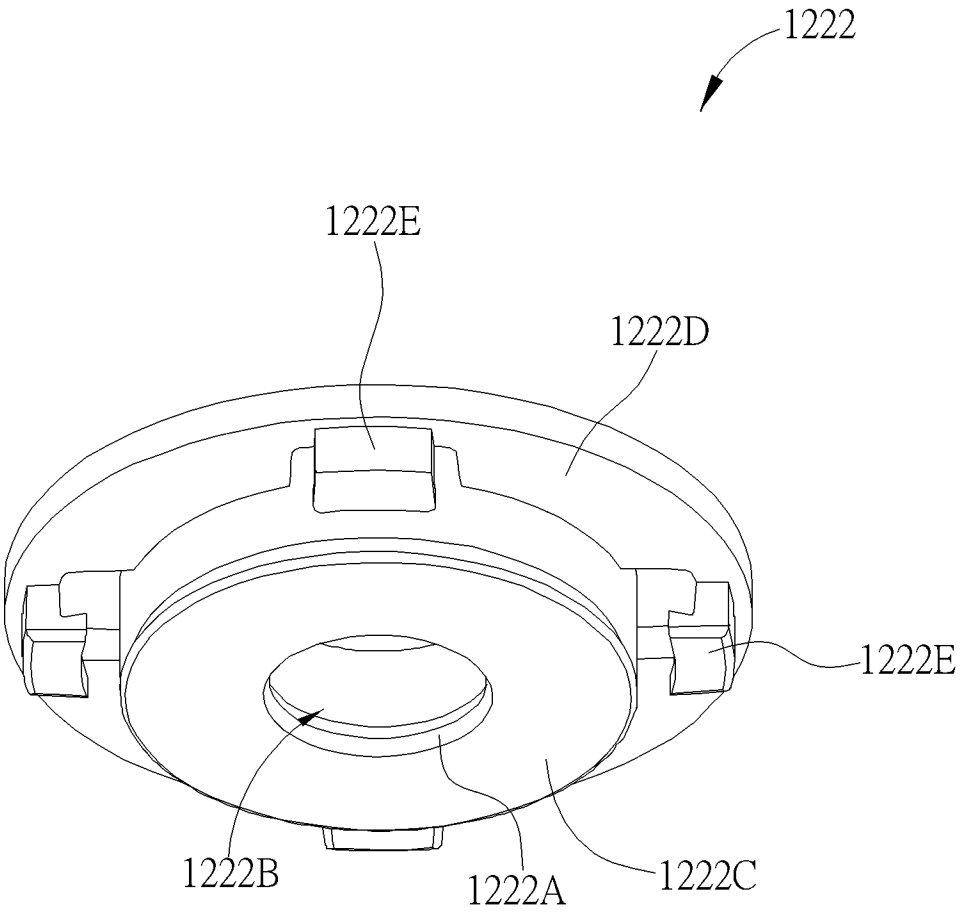
FIG. 12 is a diagram of a second cover of the vacuum pump according to the first embodiment of the present invention.

Please refer to FIG. 7 to FIG. 12. FIG. 7 is a partial diagram of the self-lacing system 12 according to the first embodiment of the present invention. FIG. 8 is a partial exploded diagram of the self-lacing system 12 according to the first embodiment of the present invention. FIG. 9 is a partial sectional diagram of the self-lacing system 12 according to the first embodiment of the present invention. FIG. 10 is a partial enlarged diagram of the self-lacing system 12 according to the first embodiment of the present invention. FIG. 11 is a diagram of a first cover 1221 of the vacuum pump 122 according to the first embodiment of the present invention. FIG. 12 is a diagram of a second cover 1222 of the vacuum pump 122 according to the first embodiment of the present invention. As shown in FIG. 7 to FIG. 12, the vacuum pump 122 includes the first cover 1221, the second cover 1222, a first sealing component 1223 and eight resilient components 1224. The second cover 1222 is disposed on the first cover 1221 and movable relative to the first cover 1221 between a first position and a second position. The first sealing component 1223 is disposed between the first cover 1221 and the second cover 1222 for preventing leakage of the fluid from a gap between the first cover 1221 and the second cover 1222. A suction port 1222A is formed on the second cover 1222 and has a suction communication channel 1222B. A discharge port 1221A is formed on the first cover 1221 and has a discharge communication channel 1221B. A chamber 1225 is formed between the first cover 1221 and the second cover 1222 when the second cover 1222 is located at the first position relative to the first cover 1221, as shown in FIG. 9. Volume, i.e., available fluid volume, of the chamber 1225 changes during movement of the second cover 1222 relative to the first cover 1221. The chamber 1225 is compressed to force fluid, such as air, inside the chamber 1225 outwardly via the discharge communication channel 1221B when the second cover 1222 moves relative to the first cover 1221 from the first position to the second position downwardly, and fluid, such as air, inside the air bag assembly 121 is introduced to flow into the chamber 1225 via the suction communication channel 1122B when the second cover 1222 moves relative to the first cover 1221 from the second position to the first position upwardly. The eight resilient components 1224 are abutted between the first cover 1221 and the second cover 1222 to bias the second cover 1222 to move relative to the first cover 1221 to the first position.

Preferably, in this embodiment, the first sealing component 1223 can be an O-ring. However, the number, the configuration and the type of the first sealing component are not limited to this embodiment. For example, in another embodiment, the vacuum pump can include two or more first sealing components. Alternatively, in another embodiment, the first sealing component can be omitted.

Preferably, in this embodiment, the eight resilient components 1224 are disposed at intervals between a periphery of the first cover 1221 and a periphery of the second cover 1222 for balance of the first cover 1221 and the second cover 1222. Furthermore, each resilient component 1224 can be a compression spring. However, the number and the configuration of the resilient components are not limited to this embodiment. For example, in another embodiment, the vacuum pump can include only one resilient component inside the chamber and abutted between a central portion of the first cover and a central portion the second cover.

Specifically, the first cover 1221 includes an inner wall 1221C and an outer wall 1221D located outside the inner wall 1221C. The second cover 1222 includes an inner protruding platform 1222C and an outer abutting platform wall 1222D located outside the inner protruding platform 1222C. The chamber 1225 is enclosed by the inner wall 1221C and the inner protruding platform 1222C. Eight accommodating spaces 1221E are formed between the inner wall 1221C and the outer wall 1221D. The eight resilient components 1224 are respectively disposed inside the eight accommodating spaces 1221E and abut against the outer abutting platform 1222D to bias the second cover 1222 to move relative to the first cover 1221 to the first position. It should be noticed that compared to the configuration of the resilient component disposed inside the chamber, the configuration of the resilient components disposed out of the chamber can effectively facilitate evacuation of the air bag assembly because the volume of the chamber can be reduced as much as possible.

Additionally, the first cover 1221 further includes four first engaging portions 1221F protruding from the inner wall 1221C outwardly. The second cover 1222 further includes four second engaging portions 1222E protruding from the outer abutting platform 1222D inwardly, and the four first engaging portions 1221F respectively engage with the four second engaging portions 1222E when the second cover 1222 moves relative to the first cover 1221 to the first position.

Preferably, in this embodiment, the four first engaging portions 1221F are disposed at intervals along the periphery of the first cover 1221, and the four second engaging portions 1222E are disposed at intervals along the periphery of the second cover 1222. Furthermore, each first engaging portion 1221F can be a hook, and each second engaging portion 1222E can be an L-shaped structure. However, the number and the configuration of the first engaging portion, and the number and the configuration of the second engaging portion are not limited to this embodiment. For example, in another embodiment, the first cover can include only one first engaging portion protruding from the inner wall inwardly, and the second cover can include only one second engaging portion protruding from the inner protruding platform outwardly.

In order to achieve easy assembly of the vacuum pump 122 and the air bag assembly 121, the vacuum pump 122 further includes a connecting head 1226 and a second sealing component 1227. The connecting head 1226 can be connected to the air bag assembly 121 by high frequency heat sealing and detachably connected to the suction port 1222A. The connecting head 1226 has a connection communication channel 1226A configured to communicate the air bag assembly 121 to the suction communication channel 1222B, and the second sealing component 1227 is disposed between the connecting head 1226 and the suction port 1222A for preventing leakage of fluid from a gap between the detachable connecting head 1226 and the suction port 1222A.

Preferably, in this embodiment, the second sealing component 1227 can be an O-ring. However, the number of the second sealing component and structure of the vacuum pump are not limited to this embodiment. For example, in another embodiment, the vacuum pump can include two or more sealing components disposed between the detachable connecting head and the suction port. Alternatively, in another embodiment, the connecting head can be fixedly connected to the suction port, and the second sealing component can be omitted. In other words, the connecting head and suction port, i.e., the second cover can be formed in a one piece structure. Alternatively, in another embodiment, the air bag assembly can be connected to the suction port directly, and the connecting head can be omitted.

In order to facilitate evacuation of the air bag assembly 121, the vacuum pump 122 can further include a discharge check valve 1228 and a suction check valve 1229. The discharge check valve 1228 can be disposed on the discharge port 1221A and configured to only allow the fluid inside the chamber 1225 to flow out of the chamber 1225 via the discharge communication channel 1221B in a single direction. The suction check valve 1229 can be disposed on the connecting head 1226 and configured to only allow the fluid inside the air bag assembly 121 to flow into the chamber 1225 in a single direction. However, the configuration of the discharge check valve and the suction check valve are not limited to this embodiment. For example, in another embodiment, the suction check valve can be disposed on the suction port.

When it is desired to evacuate the air bag assembly 121 for ensuring the proper fit of the shoe 11, the wearer can wear the shoe 11 so as to step on the vacuum pump 122 to force the second cover 1222 to move relative to the first cover 1221 from the first position to the second position. When the second cover 1222 moves relative to the first cover 1221 from the first position to the second position, the chamber 1225 is compressed to force the fluid inside the chamber 1225 to flow outwardly via the discharge communication channel 1221B. During the aforementioned process, the suction check valve 1229 prevents the fluid inside the chamber 1225 from flowing into the air bag assembly 121. Besides, the first sealing component 1223 prevents the fluid inside the chamber 1225 from flowing outwardly through the gap between the first cover 1221 and the second cover 1222, and the second sealing component 1227 prevents the fluid inside the chamber 1225 from flowing outwardly from the gap between the connecting head 1226 and the suction port 1222A.

Afterwards, when the vacuum pump 122 is released, the eight resilient components 1224 can recover the second cover 1222 to move relative to the first cover 1221 from the second position to the first position. When the second cover 1222 moves relative to the first cover 1221 from the second position to the first position, the fluid inside the air bag assembly 121 is introduced to flow into the chamber 1225 via the connection communication channel 1226A and the suction communication channel 1222B, so as to evacuate the air bag assembly 121. During the aforementioned process, the discharge check valve 1228, the first sealing component 1223 and the second sealing component 1227 prevent environmental fluid from flowing into the chamber 1225, which increases the evacuating efficiency of the air bag assembly 121. The wearer can carry out one or more cycles of stepping and releasing the vacuum pump 122 until all of the fluid is evacuated out of the air bag assembly 121. As shown in FIG. 2, during evacuation of the air bag assembly 121, the air passage 1212 is collapsed, so that a length in the second direction D2 and/or a width in the first direction D1 of the air bag assembly 121 is reduced, which drives the upper portion of the shoe 11 to shrink and reshape for tightening the shoe 11.

Figure 14:
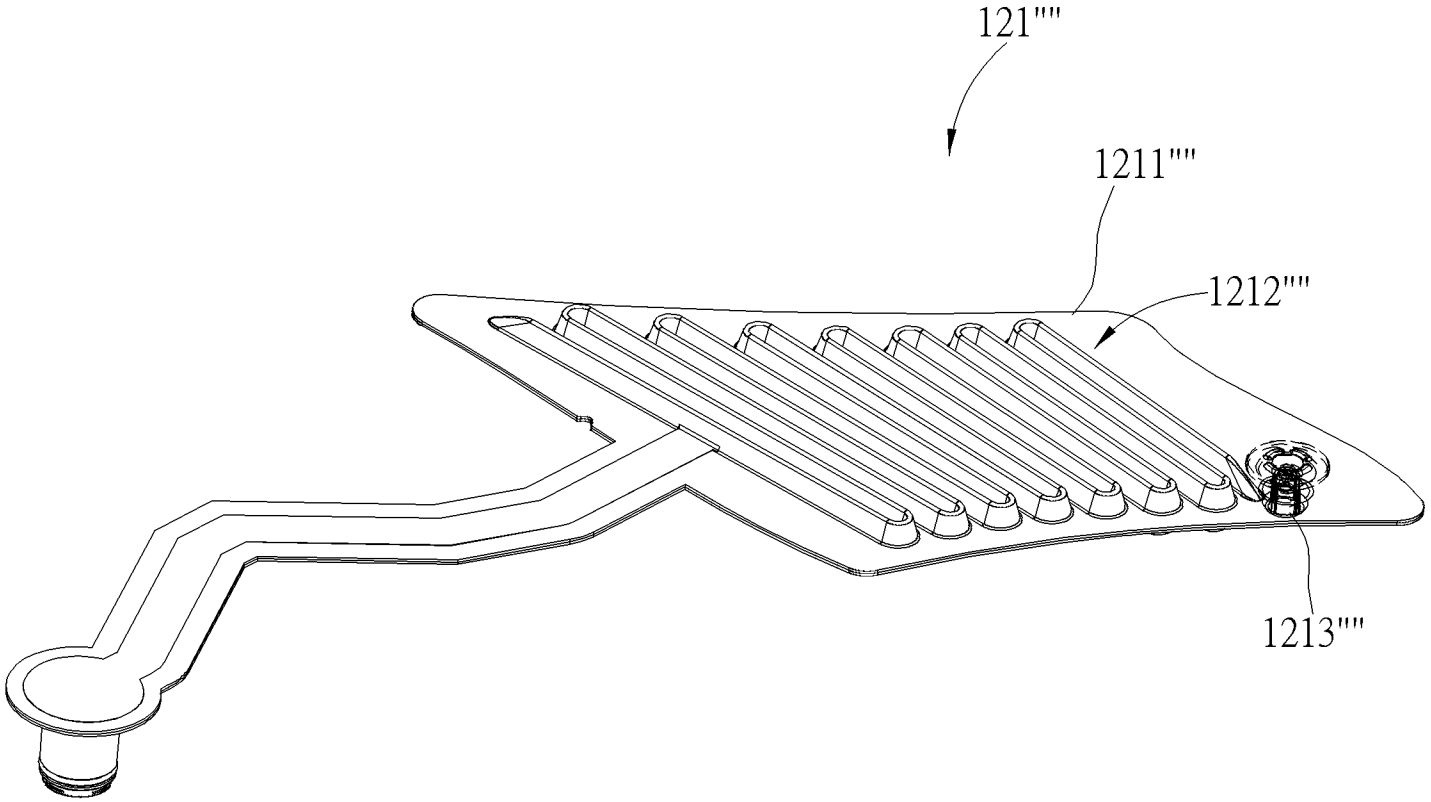
FIG. 14 and FIG. 15 are diagrams of an air bag assembly at different views according to a fifth embodiment of the present invention.
Figure 15:
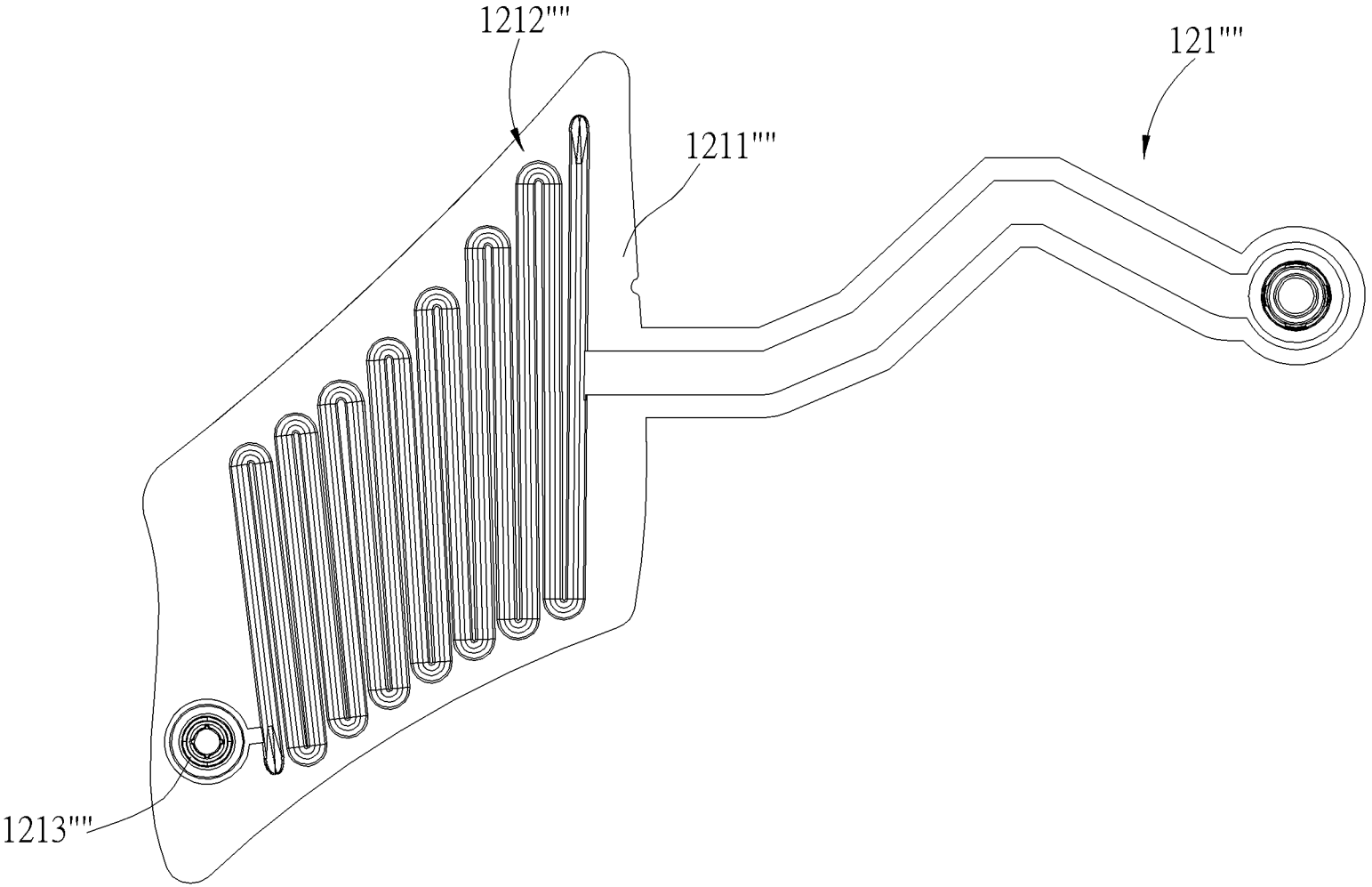
Figure 16:
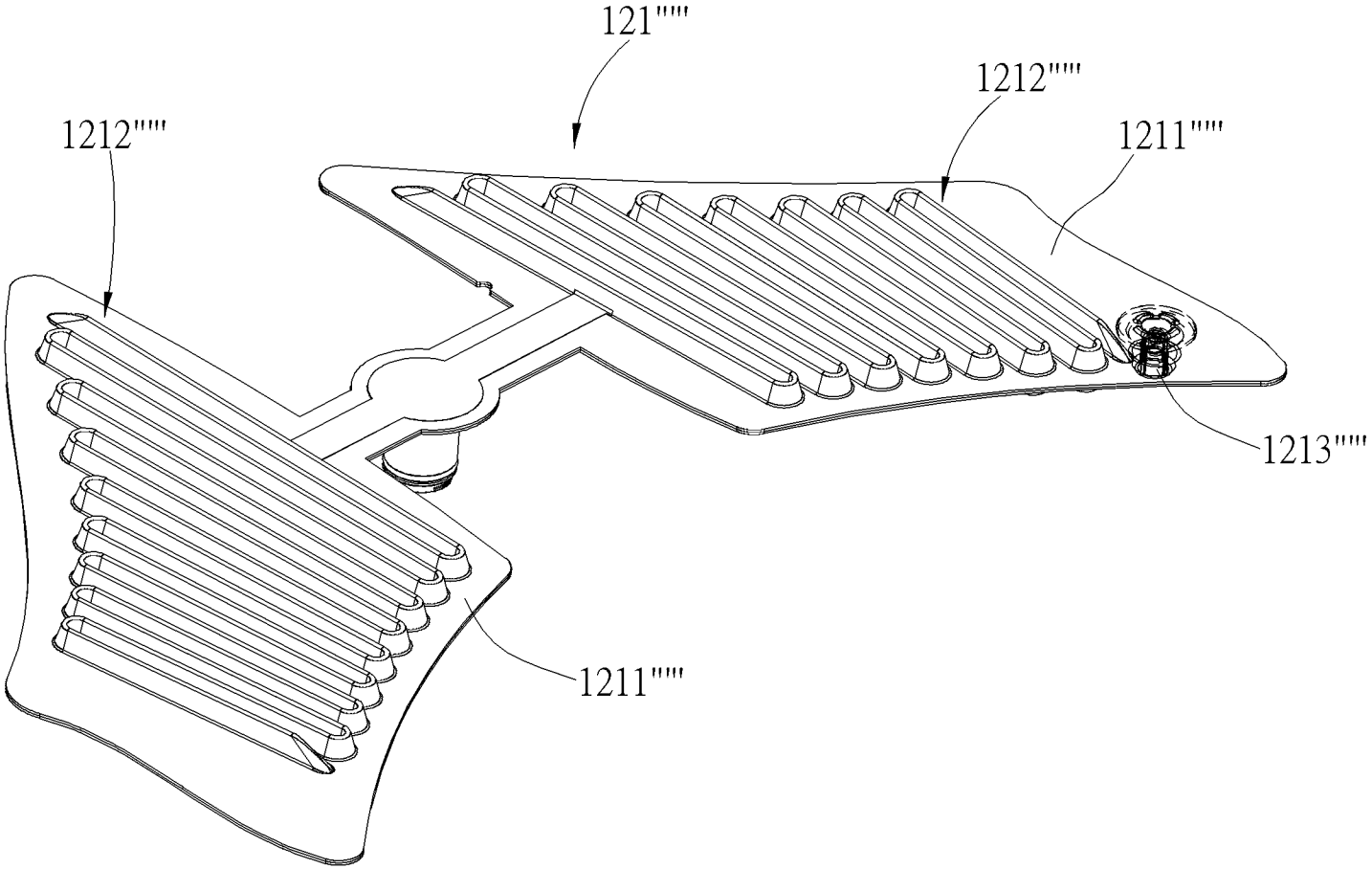
FIG. 16 and FIG. 17 are diagrams of an air bag assembly at different views according to a sixth embodiment of the present invention.
Figure 17:
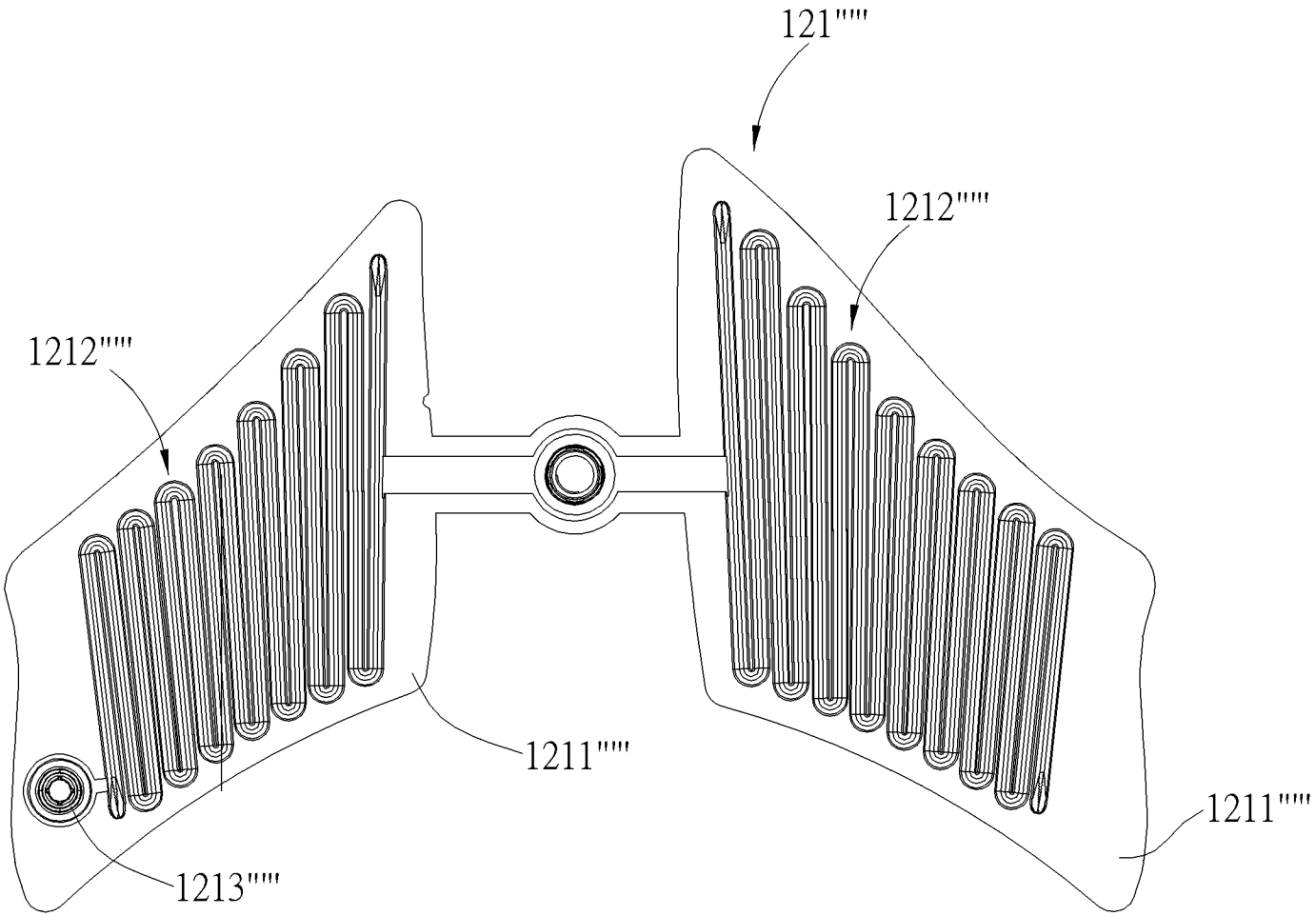

Understandably, in this embodiment, the air bag assembly 121 can be configured to be incompletely airtight, so that the environmental fluid can flow into the air passage 1212 of the air bag assembly 121 to expand the air bag assembly 121 for loosening the shoe 11 once the wearer stops stepping and releasing the vacuum pump 122 after the evacuation of the air bag assembly 121. However, the present invention is not limited to this embodiment. For example, please refer to FIG. 14 to FIG. 17. FIG. 14 and FIG. 15 are diagrams of an air bag assembly 121"" at different views according to a fifth embodiment of the present invention. FIG. 16 and FIG. 17 are diagrams of an air bag assembly 121 at different views according to a sixth embodiment of the present invention. As shown in FIG. 14 and FIG. 15, there can be a relief valve 1213"" disposed on a bag body 1211"" of the air bag assembly 121"" and communicated with air passage 1212". As shown in FIG. 16 and FIG. 17, there can be a relief valve 1213 disposed on one of two bag bodies 1211 of the air bag assembly 121 and communicated with two air passages 1212. The wearer can operate the relief valve to allow the environmental fluid to flow into the air bag assembly to recover the air passage (s) for loosening the shoe more efficiently.

However, the vacuum pump of the present invention is not limited to evacuate the air bag assembly disposed on the shoe. The vacuum pump also can be used for evacuating the air bag assembly disposed on clothing, a bag, a watch belt or a related wearable accessory. The vacuum pump even can be used for evacuating an air bag assembly, like a balloon, which has structure and operational principle different from the one of the aforementioned air bag assembly.

In contrast to the prior art, the present invention utilizes the vacuum pump disposed on the sole portion of the shoe to evacuate the air bag assembly disposed on the upper portion of the shoe. Therefore, the present invention allows a wearer to ensure proper fit of the shoe by stepping on the vacuum pump with a foot to evacuate the air bag assembly to reshape the upper portion of the shoe to the wearer. No other operation is needed, which brings convenience in use.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A self-lacing system for a shoe, the self-lacing system comprising:

an air bag assembly attached on an upper portion of the shoe, at least one air passage being formed on the air bag assembly; and a vacuum pump attached on a sole portion of the shoe, the vacuum pump comprising:

a first cover, a discharge port being formed on the first cover and having a discharge communication channel;

a second cover disposed on the first cover and movable relative to the first cover between a first position and a second position, a chamber being formed between the first cover and the second cover when the second cover is located at the first position relative to the first cover, volume of the chamber changing during movement of the second cover relative to the first cover, and a suction port being formed on the second cover and having a suction communication channel;

a connecting head detachably connected to the suction port and connected to the air bag assembly, the connecting head having a connection communication channel configured to communicate the air bag assembly to the suction communication channel; and at least one sealing component disposed between the connecting head and the suction port;

wherein the chamber is compressed to force fluid inside the chamber outwardly via the discharge communication channel when the second cover moves relative to the first cover from the first position to the second position, and when the second cover moves relative to the first cover from the second position to the first position, fluid inside the air bag assembly is introduced to flow into the chamber via the suction communication channel to collapse the at least one air passage for shrinking and reshaping the air bag assembly, so that the upper portion of the shoe is driven by the air bag assembly to shrink and reshape for tightening the shoe.

2. The self-lacing system of claim 1, wherein the vacuum pump further comprises:

a discharge check valve configured to only allow the fluid inside the chamber to flow out of the chamber via the discharge communication channel in a single direction.

3. The self-lacing system of claim 1, wherein the vacuum pump further comprises:

a suction check valve configured to only allow the fluid inside the air bag assembly to flow into the chamber in a single direction.

4. The self-lacing system of claim 1, wherein the vacuum pump further comprises:

at least one resilient component disposed between the first cover and the second cover to bias the second cover to move relative to the first cover to the first position.

5. The self-lacing system of claim 1, wherein the vacuum pump further comprises:

at least another one sealing component disposed between the first cover and the second cover.

6. The self-lacing system of claim 1, wherein the first cover comprises at least one first engaging portion, the second cover comprises at least one second engaging portion, and the at least one first engaging portion engages with the at least one second engaging portion when the second cover moves relative to the first cover to the first position.

7. The self-lacing system of claim 1, wherein the first cover comprises an inner wall and an outer wall located outside the inner wall, the second cover comprises an inner protruding platform and an outer abutting platform wall located outside the inner protruding platform, the chamber is enclosed by the inner wall and the inner protruding platform, at least one accommodating space is formed between the inner wall and the outer wall, and the vacuum pump further comprises at least one resilient component disposed inside the at least one accommodating space and abutting against the outer abutting platform.

8. The self-lacing system of claim 7, wherein the first cover further comprises at least one first engaging portion protruding from the inner wall, the second cover further comprises at least one second engaging portion protruding from the outer abutting platform, and the at least one first engaging portion engages with the at least one second engaging portion when the second cover moves relative to the first cover to the first position.

9. A vacuum pump for evacuating an air bag assembly, the vacuum pump comprising:

a first cover, a discharge port being formed on the first cover and having a discharge communication channel, the first cover comprising an inner wall and an outer wall located outside the inner wall, at least one accommodating space being formed between the inner wall and the outer wall;

a second cover disposed on the first cover and movable relative to the first cover between a first position and a second position, the second cover comprising an inner protruding platform and an outer abutting platform wall located outside the inner protruding platform, a chamber being formed between the first cover and the second cover and enclosed by the inner wall and the inner protruding platform when the second cover is located at the first position relative to the first cover, volume of the chamber changing during movement of the second cover relative to the first cover, and a suction port being formed on the second cover and having provide a suction communication channel; and at least one resilient component disposed inside the at least one accommodating space and abutting against the outer abutting platform;

wherein the chamber is compressed to force fluid inside the chamber outwardly via the discharge communication channel when the second cover moves relative to the first cover from the first position to the second position, and fluid inside the air bag assembly is introduced to flow into the chamber via the suction communication channel when the second cover moves relative to the first cover from the second position to the first position.

10. The vacuum pump of claim 9, further comprising:

a discharge check valve configured to only allow the fluid inside the chamber to flow out of the chamber via the discharge communication channel in a single direction.

11. The vacuum pump of claim 9, further comprising:

a suction check valve configured to only allow the fluid inside the air bag assembly to flow into the chamber in a single direction.

12. The vacuum pump of claim 9, further comprising:

at least one resilient component disposed between the first cover and the second cover to bias the second cover to move relative to the first cover to the first position.

13. The vacuum pump of claim 9, further comprising:

at least one sealing component disposed between the first cover and the second cover.

14. The vacuum pump of claim 9, wherein the first cover comprises at least one first engaging portion, the second cover comprises at least one second engaging portion, and the at least one first engaging portion engages with the at least one second engaging portion when the second cover moves relative to the first cover to the first position.

15. The vacuum pump of claim 9, further comprising:

a connecting head connected to the suction port and the air bag assembly, and the connecting head having a connection communication channel configured to communicate the air bag assembly to the suction communication channel.

16. The vacuum pump of claim 15, wherein the connecting head is detachably connected to the suction port, and the vacuum pump further comprises at least one sealing component disposed between the connecting head and the suction port.

17. The vacuum pump of claim 9, wherein the first cover further comprises at least one first engaging portion protruding from the inner wall, the second cover further comprises at least one second engaging portion protruding from the outer abutting platform, and the at least one first engaging portion engages with the at least one second engaging portion when the second cover moves relative to the first cover to the first position.

* * * * *